US006017625A

United States Patent [19]

Sato et al.

[11] Patent Number: 6,017,625

[45] Date of Patent: Jan. 25, 2000

[54] WATER-ABSORPTIVE POLYURETHANE FIBER AND METHOD OF PRODUCING THE SAME

[75] Inventors: Takaya Sato; Tsutomu Uehara; Hiroshi Yoshida, all of Tokyo, Japan

[73] Assignee: Nisshinbo Industries, Inc., Tokyo, Japan

[21] Appl. No.: 09/116,221

[22] Filed: Jul. 16, 1998

[51] Int. Cl.[7] ..... D07G 3/00; C08G 14/10; C08G 18/00

[52] U.S. Cl. ..... 428/364; 428/394; 578/44; 578/61

[58] Field of Search ..... 428/364, 394; 528/61, 62, 63, 64, 44

[56] References Cited

U.S. PATENT DOCUMENTS

| | | | |
|---|---|---|---|
| 3,901,852 | 8/1975 | Shah | 260/47 CB |
| 5,340,902 | 8/1994 | Smith et al. | 528/61 |

FOREIGN PATENT DOCUMENTS

| | | |
|---|---|---|
| 0172610 | 2/1986 | European Pat. Off. . |
| 0404517 | 12/1990 | European Pat. Off. . |
| 0559911 | 9/1993 | European Pat. Off. . |
| 96/06875 | 3/1996 | WIPO . |

*Primary Examiner*—Newton Edwards

*Attorney, Agent, or Firm*—Wenderoth, Lind & Ponack L.L.P.

[57] ABSTRACT

A water-insoluble, nonionic water-absorptive polyurethane fiber that combines the properties of high water absorptivity and excellent physical strength is produced by extrusion from a thermoplastic polyurethane resin composition at a temperature higher than its melting point. The thermoplastic polyurethane resin composition, which has a water absorption rate within the range of 200–3,000%, is obtained by reacting a polyisocyanate compound, a water-soluble polyalkylene ether polyol having a weight-average molecular weight of 2,000–13,000 and a chain extender at an equivalent ratio (R ratio) between the equivalent number of NCO groups and the equivalent number of OH groups in the range of 1.0 to 1.8. Also provided is a method of producing the water-absorptive polyurethane fiber.

9 Claims, No Drawings

WATER-ABSORPTIVE POLYURETHANE FIBER AND METHOD OF PRODUCING THE SAME

BACKGROUND OF THE INVENTION

1. Field of the Invention

This invention relates to a water-absorptive polyurethane fiber using a water-absorptive thermoplastic polyurethane resin material and to a method of producing the same. More particularly, this invention relates to an insoluble and nonionic water-absorptive polyurethane fiber with potential utility in environmental fields, including water treatment and deodorization, as well as in civil engineering, medicine and other fields, and to a method of producing the same.

2. Description of the Background Art

Known granular polymers exhibiting high water-absorptivity include resins obtained by subjecting a polyacrylic acid polymer, a polyvinylalcohol polymer or the like to a suitable degree of crosslinking, starch-graft resins, and the like. Among fibrous types are the so-called water-absorptive fibers, including acrylonitrile composite fibers having a carboxyl acid salt group introduced into a part of the surface layer, polyacrylic acid polymer fiber, anhydrous maleic acid fiber, polyvinylalcohol fiber, alginic acid fiber and the like (see Japanese Patent Public Disclosures No. 1-280069 and No. 3-279471).

The conventional water-absorptive fibers have the following drawbacks:

1) The water-absorptive fibers imparted with a carboxyl group or other ionic hydrophilic group become tacky upon water absorption and do not readily absorb ionic aqueous solutions and aqueous solutions containing an organic solvent.
2) Most of the water-absorptive fibers have low physical strength upon water absorption and when imparted with a crosslinked structure to confer adequate physical fiber strength become fibers that are poor in water absorption and swelling.
3) Most of the conventional water-absorptive fibers are short fibers that require a binder or the like when, for example, converted into the form of non-woven fabric, and, as such, are low in form impartibility.
4) None offer a material having the excellent water retention, hydrophilicity, water absorptivity, biocompatibility and resistance to physical strength degradation upon water absorption that are needed for use in wide-ranging fields such as water treatment, deodorization, civil engineering and medicine.

Based on the results of a study directed to finding a solution to these problems, the inventors developed a method of producing a water-insoluble, nonionic water-absorptive polyurethane fiber of good processability that combines the properties of high water absorptivity, high biocompatibility and excellent physical strength.

SUMMARY OF THE INVENTION

To overcome the aforesaid shortcomings of the prior art, this invention utilizes as a thermoplastic polyurethane resin composition for constituting a water-absorptive polyurethane fiber a thermoplastic polyurethane resin obtained by reacting a polyisocyanate compound, a water-soluble polyalkylene ether polyol having an average molecular weight (all molecular weights in the present application are weight-average molecular weights) of 2,000–13,000, preferably 4,000–8,000, and a chain extender at an equivalent ratio between the equivalent number of OH groups possessed by the water-soluble polyalkylene ether polyol and the chain extender and the equivalent number of NCO groups possessed by the polyisocyanate compound, said equivalent ratio being defined as R ratio (Equation (1)), falling within the range of 1.0 to 1.8, the thermoplastic polyurethane resin composition having a water absorption rate as defined by Equation (2) falling within the range of 200–3,000%:

$$\text{R ratio} = \frac{\text{NCO group equivalent number}}{\text{OH group equivalent number}} \qquad \text{Equation (1)}$$

$$\text{Water absorption rate (\%)} = \frac{\text{Completely swollen weight in water (g)} - \text{Bone-dry weight (g)}}{\text{Bone-dry weight (g)}} \times 100, \qquad \text{Equation (2)}$$

completely swollen weight being defined as weight when no further weight change occurs during soaking in 25° C. pure water and bone-dry weight being defined as weight when no further weight loss occurs during drying at 100° C.

The water-absorptive polyurethane fiber according to the invention is characterized in being produced by holding the thermoplastic polyurethane resin composition at a temperature not lower than its melting point to put it in a molten state and extruding the molten thermoplastic polyurethane resin composition from a nozzle.

In one of its aspects, the method of producing a water-absorptive polyurethane fiber according to the invention is characterized in comprising the steps of holding the thermoplastic polyurethane resin composition at a temperature not lower than its melting point to put it in a molten state, extruding the molten thermoplastic polyurethane resin composition from a nozzle, and concurrently cooling and winding up the extruded thermoplastic polyurethane resin.

In another of its aspects, the method of producing a water-absorptive polyurethane fiber according to the invention is characterized in comprising the steps of holding the thermoplastic polyurethane resin composition at a temperature not lower than its melting point to put it in a molten state, extruding the molten thermoplastic polyurethane resin composition from a nozzle, and concurrently drawing, cooling and winding up the extruded thermoplastic polyurethane resin.

In another of its aspects, the method of producing a water-absorptive polyurethane fiber according to the invention is characterized in comprising the steps of holding the thermoplastic polyurethane resin composition at a temperature not lower than its melting point to put it in a molten state, extruding the molten thermoplastic polyurethane resin composition from a nozzle, cooling the extruded thermoplastic polyurethane resin and subjecting the cooled thermoplastic polyurethane resin to secondary drawing at a temperature at least 10° C. lower than the melting point.

The water-absorptive thermoplastic polyurethane resin composition in this invention is a polyurethane copolymer bonded head to tail by urethane bonding and consists of soft segments obtained by reaction between the polyisocyanate compound and the water-soluble polyalkylene ether polyol and hard segments obtained by reaction between the polyisocyanate compound and the chain extender.

Polyisocyanate compounds usable in the water-absorptive thermoplastic polyurethane resin composition in this invention include, for example, tolylene diisocyanate, 4,4'diphenylmethane diisocyanate, naphthalene diisocyanate, xylylene diisocyanate, 4,4'dicyclohexylmethane diisocyanate, hexamethylene diisocyanate, isophoron diisocyanate and other aromatic, aliphatic, alicyclic isocyanates and the like, triisocyanate and tetraisocyanate. Among these, 4,4'diphenylmethane diisocyanate is preferable from the points of reactivity with the water-soluble polyalkylene ether polyol, fiber properties, easy availability, etc.

The water-soluble polyalkylene ether polyol used in the water-absorptive thermoplastic polyurethane resin composition in this invention is preferably a water-soluble ethylene oxide-propylene oxide copolymer polyether polyol, ethylene oxide-tetrahydrofuran copolymer polyether polyol or polyethylene glycol having two or more terminal hydroxyl groups per molecule. The ethylene oxide content is preferably 70% by weight or greater, more preferably 85% or greater. At an ethylene oxide content of less than 70%, the water absorption rate of the resin composition may be low.

The number of crosslinking points can be increased and the physical strength of the resin composition improved by concurrent use of small amount of a polyol other than a diol.

The weight-average molecular weight of the water-soluble polyalkylene ether polyol used in this invention is preferably in the range of 2,000–13,000, more preferably 4,000–8,000, and is considered to exert a major effect on the water absorption rate of the resin. When the weight-average molecular weight of the water-soluble polyalkylene ether polyol is low, the molecular weight of the soft segments decreases and there is observed a tendency for the water absorption rate of the resin to decrease as a result. A weight-average molecular weight exceeding 13,000 is undesirable because it is likely to increase the viscosity during synthesis, raise the melting point and have other adverse effects.

The water-soluble polyalkylene ether polyol used in this invention can be used as a mixture of several types differing in number of terminal hydroxyl groups per molecule, molecular weight and ethylene oxide content.

The chain extender used in this invention can be one having a weight-average molecular weight of 30–1,000 that can be reacted with a polymer having terminal NCO manufactured by the reaction between a polyalkylene ether polyol and a polyisocyanate compound. Specific examples include ethylene glycol, 1,2-propylene glycol, 1,3-propylene glycol, 1,3-butanediol, 1,4-butanediol, 1,5-pentanediol, 1,6-hexanediol, 2,2-dimethyl-1,3-propanediol, diethylene glycol, dipropylene glycol, 1,4-cyclohexanedimethanol, 1,4-bis-(β-hydroxyethoxy) benzene, p-xylylenediol, phenyldiethanolamine and methyldiethanolamine.

The chain extender used in this invention can also be a normal chain polyalkylene ether polyol having a weight-average molecular weight of not more than 1000 and possessing two or more OH groups per molecule. Specific examples include ethylene oxide-propylene oxide copolymer polyether polyol, ethylene oxide-tetrahydrofuran copolymer polyether polyol and polyethylene glycol having two or more terminal hydroxyl groups per molecule and a weight-average molecular weight of not more than 1000. The ethylene oxide content is preferably 70% or greater, more preferably 85% or greater. At an ethylene oxide content of less than 70%, the water absorption rate of the resin composition may be low.

The ratio between the contents of the water-soluble polyalkylene ether polyol and the chain extender used in the invention can be varied depending on the molecular weights of these compounds and the physical properties desired of the thermoplastic polyurethane resin composition upon water absorption.

The ratio between the sum of the OH group equivalent numbers of the two compounds and the equivalent number of the NCO groups possessed by the polyisocyanate compound, called the "R ratio," is preferably in the range of 1.0–1.8, more preferably 1.0–1.6.

Thus this invention not only permits use of complete polyurethane copolymers having undergone thorough polymer synthesis reaction but also permits use of incomplete thermoplastic polyurethanes, i.e., permits polyurethane copolymers having remaining active groups such as isocyanate groups to be used by subjecting them to crosslinking after formation.

Increased intermolecular crosslinking for enhancing the physical strength after water absorption and the water resistance of the resin can be achieved by increasing the equivalent number of the NCO groups. However, the equivalent number of the NCO groups must be within the aforesaid range to secure a high water absorption rate.

One way of obtaining an equivalent number of the NCO groups falling within the prescribed range is to first react the water-soluble polyalkylene ether polyol and the polyisocyanate compound and then block some of the NCO groups in the polyisocyanate compound obtained with a monoalcohol.

Monoalcohols usable for the purpose include methanol, ethanol, butanol, ethylene glycol monomethyl ether, diethylene glycol monomethyl ether and polyethylene glycol monomethyl ether. Polyethylene glycol monomethyl ether is best for enhancing the water absorption rate of the resin.

The water-absorptive thermoplastic polyurethane resin composition in this invention can be synthesized either by the prepolymer method of reacting the water-soluble polyalkylene ether polyol and the polyisocyanate compound first and then reacting the result with the chain extender or the one-shot method of mixing all of the reaction materials at one time.

The water absorption rate of the thermoplastic polyurethane resin composition in this invention is defined by Equation (2):

$$\text{Water absorption rate (\%)} = \frac{\text{Completely swollen weight in water (g)} - \text{Bone-dry weight (g)}}{\text{Bone-dry weight (g)}} \times 100, \qquad \text{Equation (2)}$$

completely swollen weight being defined as weight when no further weight change occurs during soaking in 25° C. pure water and bone-dry weight being defined as weight when no further weight loss occurs during drying at 100° C.

When the water absorption rate is less than 200%, the description "water-absorptive resin" is inappropriate. When the water absorption rate is greater than 3,000%, the thermoplastic polyurethane resin composition falls so low in physical strength upon water absorption as to lose its utility. Although the aspect ratio of the water-absorptive polyurethane fiber of this invention (length/diameter) is not limited, wind-up during production, and subsequent processing and transport of the product are facilitated when the aspect ratio is greater than 100.

The diameter of the water-absorptive polyurethane fiber of the invention is preferably in the range of 0.1–20 mm in view of the strength required of the swollen fiber in actual use. When water-absorptive polyurethane fiber of the invention is processed into braided rope, woven cloth or the like, a diameter of 0.2–2 mm is sufficient to prevent breakage of the braided rope or woven cloth by twisting or bending of the swollen fiber. The water-absorptive polyurethane fiber of the invention swells 1.2–1.5 fold in the radial direction.

The method of this invention produces a water-absorptive polyurethane fiber by holding a thermoplastic polyurethane resin composition produced in the foregoing manner at a temperature not lower than its melting point but lower than its decomposition temperature, extruding the molten thermoplastic polyurethane resin composition from the nozzle of an extruder, and concurrently cooling and taking up (e.g., winding) the extruded thermoplastic polyurethane resin.

The three methods set out below are available for regulating the diameter of the polyurethane fiber. These methods can be selected or combined as appropriate in light of the melting point and molten viscosity of the raw material thermoplastic polyurethane resin composition and the desired diameter of the polyurethane fiber.

(1) Extruding the thermoplastic polyurethane resin composition from a nozzle matched to the desired diameter of the polyurethane fiber, followed by cooling and optional wind-up.

(2) Drawing the thermoplastic polyurethane resin composition extruded from a nozzle to the desired diameter while still molten, followed by cooling and optional wind-up.

(3) Cooling the thermoplastic polyurethane resin composition extruded from a nozzle and subjecting the cooled thermoplastic polyurethane resin to secondary drawing to the desired diameter at a temperature at least 10° C. lower than the melting point, optionally followed by wind-up.

The water-absorptive polyurethane fiber obtained by any of these methods swells with water absorption. Of particular note, however, is that the water-absorptive polyurethane fiber produced by method (3), which is obtained by subjecting a thermoplastic polyurethane resin composition formed into a fiber to secondary drawing, swells in the diameter direction with water absorption while simultaneously shrinking in the longitudinal direction to its length prior to the secondary drawing. This action is thought to occur because the dislocation of the polymer molecules caused by the secondary drawing is relieved by water molecules invading between the polymer molecules at the time of water-swelling. It is irreversible.

EXAMPLE OF SPECIFIC PROCEDURE

The invention will now be explained with reference to an example of the specific procedure employed.

The required amount of water-soluble polyalkylene ether polyol having a weight-average molecular weight of 2,000–13,000 is cast into a reactor equipped with a stirrer. Preheating is conducted at a temperature not less than 100° C. under a nitrogen gas atmosphere to drive off the water content of the water-soluble polyalkylene ether polyol.

The temperature in the reactor is then set to 110–140° C. The required amount of a polyisocyanate compound is added to the reactor with stirring to effect prepolymer reaction. Upon completion of the prepolymer reaction, the required amount of a chain extender is added with stirring. The product is spread by pouring it onto a vat treated with a release agent and, if required, reacted at a temperature not higher than 200° C. to complete the reaction with the chain extender and thereby obtain a thermoplastic polyurethane resin composition. The prepolymer reaction and the reaction with the chain extender can, if necessary, be promoted by use of an organometallic or amine catalyst.

The thermoplastic polyurethane resin composition produced in this manner is supplied to an extruder either after cooling a pulverization or directly in molten state. The extruder used is a single- or multi-axial screw mixing extruder that effects melting by heating under application of shearing force. A melting point of 180–230° C. is suitable.

The thermoplastic polyurethane resin composition extruded from the extruder nozzle is drawn to the required diameter under cooling, applied with oil and wound up. The forced air cooling method is preferably adopted. Water cooling is undesirable because it causes local water absorption and swelling of the polyurethane fiber.

EXAMPLES

The invention will now be explained with reference to specific examples. It is not, however, limited to the described examples.

Example 1

One hundred parts by weight of polyethylene glycol having a weight-average molecular weight of 2,000 used as the water-soluble polyalkylene ether polyol was placed in a reactor equipped with a stirrer. Preheating was conducted at 110° C. for 1 hour under a nitrogen gas atmosphere to drive off the water content of the polyethylene glycol. The temperature in the reactor was then set to 130° C.

Twenty-five parts by weight of 4,4'diphenylmethane diisocyanate was added to the reactor as the polyisocyanate compound and prepolymer reaction was effected for two hours with stirring. Upon completion of the prepolymer reaction, 1.19 parts by weight of 1,4butanediol was added to the reactor as a chain extender and stirring was conducted for 1 hour. (All reactions after preheating were conducted at 130° C.)

Upon completion of the reaction, the product was spread by pouring it onto a vat treated with a release agent and heat treated at 100° C. for 4 hours to obtain a thermoplastic polyurethane resin composition.

The thermoplastic polyurethane resin composition produced in this manner was cooled and then crushed into fine particles. The particles were supplied directly to a multi-axial screw mixing extruder and melted by heating to 180–230° C. under application of shearing force. The thermoplastic polyurethane resin composition extruded fromthe extruder nozzle was drawn to a diameter of 1 mm under concurrent forced air cooling and then coated with oil and wound up to a length of 100 m.

Example 2

Thermoplastic polyurethane resin composition was obtained in the same manner as in Example 1 except that 100 parts by weight of polyethylene glycol having a weight-average molecular weight of 6,000, 8.3 parts by weight of 4,4'diphenylmethane diisocyanate, and 0.4 part by weight of 1,4-butanediol were used. Polyurethane fiber was produced by the same method as in Example 1.

Example 3

Thermoplastic polyurethane resin composition was obtained in the same manner as in Example 1 except that 100 parts by weight of polyethylene glycol having a weight-average molecular weight of 10,000, 5.0 parts by weight of 4,4'diphenylmethane diisocyanate, and 0.24 part by weight of 1,4-butanediol were used. Polyurethane fiber was produced by the same method as in Example 1.

Comparative Example 1

Thermoplastic polyurethane resin composition was obtained in the same manner as in Example 1 except that 100 parts by weight of polyethylene glycol having a weight-average molecular weight of 1,000, 50 parts by weight of 4,4'diphenylmethane diisocyanate, and 2.38 parts by weight of 1,4-butanediol were used. Polyurethane fiber was produced by the same method as in Example 1.

TABLE 1

| | Polyol | | | MDI | 1,4 BDO | | Water absorption rate (%) | Tensile strength when swollen (kgf/cm$^2$) |
|---|---|---|---|---|---|---|---|---|
| | Molecular weight | EO/PO | Parts by weight/mole | Parts by weight/mole | Parts by weight/mole | R ratio | | |
| Example 1 | 2,000 | 10/0 | 100/1 | 25/2 | 1.19/0.25 | 1.6 | 350 | 22.5 |
| Example 2 | 6,000 | 10/0 | 100/1 | 8.3/2 | 0.4/0.25 | 1.6 | 1,500 | 5.0 |
| Example 3 | 10,000 | 10/0 | 100/1 | 5.0/2 | 0.24/0.25 | 1.6 | 2,500 | 2.9 |
| Example 4 | 6,000 | 10/0 | 100/1 | 8.3/2 | 1.53/1 | 1.0 | 1,300 | 4.0 |
| Example 5 | 6,000 | 10/0 | 100/1 | 8.3/2 | 0.16/0.1 | 1.8 | 1,900 | 4.2 |
| Example 6 | 6,000 | 7/3 | 100/1 | 8.3/2 | 0.4/0.25 | 1.6 | 300 | 34.9 |
| Comparative Example 1 | 1,000 | 10/0 | 100/1 | 50/2 | 2.38/0.25 | 1.6 | 180 | 42.0 |
| Comparative Example 2 | 6,000 | 5/5 | 100/1 | 8.3/2 | 0.4/0.25 | 1.6 | 120 | 45.8 |
| Comparative Example 3 | 6,000 | 10/0 | 100/1 | 8.3/2 | 2.30/1.5 | 0.8 | 190 | 38.0 |
| Comparative Example 4 | 6,000 | 10/0 | 100/1 | 10.6/2.5 | 0.4/0.25 | 2.0 | — | — |

TABLE 2

| | | Example 1 | Example 2 | Example 3 | Comparative Example 1 |
|---|---|---|---|---|---|
| Polyol | PEG molecular weight | 2,000 | 6,000 | 10,000 | 1,000* |
| | Parts by weight/mole | 100<br>0.05 | 100<br>0.017 | 100<br>0.01 | 100<br>0.1 |
| Polyisocyanate | MDI parts by weight/mole | 25<br>0.1 | 8.3<br>0.034 | 5.0<br>0.02 | 50<br>0.2 |
| Chain extender | BDO parts by weight/mole | 1.19<br>0.0125 | 0.4<br>0.004 | 0.24<br>0.0025 | 2.38<br>0.025 |
| R ratio | | 1.6 | 1.6 | 1.6 | 1.6 |
| Swelling rate (%) | | 350 | 1,280 | 2,430 | 180* |

*Outside invention scope
EO/PO: Feed weight ratio of ethylene oxide to propylene oxide used in preparing polyol
PEG: Polyethylene glycol
MDI: 4,4'diphenylmethane diisocyanate
BDO: 1,4-butanediol Examples 4–6 and Comparative Examples 2–4 were similarly produced. The results are shown in Tables 1 and 2.

The method of this invention thus provides a water-insoluble, nonionic water-absorptive polyurethane fiber.

What is claimed is:

1. A water-absorptive polyurethane fiber obtained by extruding from a nozzle a thermoplastic polyurethane resin composition that is a thermoplastic polyurethane resin obtained by reacting a polyisocyanate compound, a water-soluble polyalkylene ether polyol having a weight-average molecular weight of 2,000–13,000 and an ethylene oxide content of at least 70% by weight, and a chain extender at an equivalent ratio between the equivalent number of OH groups possessed by the water-soluble polyalkylene ether polyol and the chain extender and the equivalent number of NCO groups possessed by the polyisocyanate compound, said equivalent ratio being defined as R ratio (Equation (1)), falling within the range of 1.0 to 1.8, the thermoplastic polyurethane resin composition having a water absorption rate as defined by Equation (2) falling within the range of 200–3,000%, and the extrusion being effected with the thermoplastic polyurethane resin composition held at a temperature not lower than its melting point to be in a molten state:

$$\text{R ratio} = \frac{\text{NCO group equivalent number}}{\text{OH group equivalent number}} \qquad \text{Equation (1)}$$

$$\text{Water absorption rate (\%)} = \frac{\text{Completely swollen weight in water (g)} - \text{Bone-dry weight (g)}}{\text{Bone-dry weight (g)}} \times 100, \qquad \text{Equation (2)}$$

completely swollen weight being defined as weight when no further weight change occurs during soaking in 25° C. pure water and bone-dry weight being defined as weight when no further weight loss occurs during drying at 100° C.

2. A water-absorptive polyurethane fiber according to claim 1, wherein the water-soluble polyalkylene ether polyol is polyethylene glycol.

3. A water-absorptive polyurethane fiber according to claim 1 or 2, wherein the water-soluble polyalkylene ether polyol is polyethylene glycol having a weight-average molecular weight in the range of 4,000–8,000.

4. A method of producing a water-absorptive polyurethane fiber comprising the steps of holding a thermoplastic polyurethane resin composition of claim 1 or 2 at a temperature not lower than its melting point to put it in a molten state, extruding the molten thermoplastic polyurethane resin composition from a nozzle, and concurrently cooling the extruded thermoplastic polyurethane resin.

5. A method of producing a water-absorptive polyurethane fiber comprising the steps of holding a thermoplastic polyurethane resin composition of claim 1 or 2 at a temperature not lower than its melting point to put it in a molten state, extruding the molten thermoplastic polyurethane resin composition from a nozzle, and concurrently drawing and cooling the extruded thermoplastic polyurethane resin.

6. A method of producing a water-absorptive polyurethane fiber comprising the steps of holding a thermoplastic polyurethane resin composition of claim 1 or 2 at a temperature not lower than its melting point to put it in a molten state, extruding the molten thermoplastic polyurethane resin composition from a nozzle, cooling the extruded thermoplastic polyurethane resin and subjecting the cooled thermoplastic polyurethane resin to secondary drawing at a temperature at least 10° C. lower than the melting point.

7. A method of producing a water-absorptive polyurethane fiber comprising the steps of holding a thermoplastic polyurethane resin composition of claim 3 at a temperature not lower than its melting point to put it in a molten state, extruding the molten thermoplastic polyurethane resin composition from a nozzle, and concurrently cooling the extruded thermoplastic polyurethane resin.

8. A method of producing a water-absorptive polyurethane fiber comprising the steps of holding a thermoplastic polyurethane resin composition of claim 3 at a temperature not lower than its melting point to put it in a molten state, extruding the molten thermoplastic polyurethane resin composition from a nozzle, and concurrently drawing and cooling the extruded thermoplastic polyurethane resin.

9. A method of producing a water-absorptive polyurethane fiber comprising the steps of holding a thermoplastic polyurethane resin composition of claim 3 at a temperature not lower than its melting point to put it in a molten state, extruding the molten thermoplastic polyurethane resin composition from a nozzle, cooling the extruded thermoplastic polyurethane resin and subjecting the cooled thermoplastic polyurethane resin to secondary drawing at a temperature at least 10° C. lower than the melting point.

* * * * *

UNITED STATES PATENT AND TRADEMARK OFFICE

CERTIFICATE OF CORRECTION

PATENT NO. : 6,017,625

DATED : January 25, 2000

INVENTOR(S) : Takaya SATO et al.

It is certified that error appears in the above-identified patent and that said Letters Patent is hereby corrected as shown below:

Title page, item

--[30] Foreign Application Priority Data

July 17, 1997 [JP] Japan . . . . 9-207419--

Signed and Sealed this

Twenty-sixth Day of December, 2000

*Attest:*

Q. TODD DICKINSON

*Attesting Officer*

*Director of Patents and Trademarks*